US005940656A

United States Patent [19]

Hensel

[11] Patent Number: 5,940,656

[45] Date of Patent: Aug. 17, 1999

[54] APPARATUS FOR CLEANING TONER SUPPLY CARTRIDGE CORONA WIRE

[75] Inventor: John Hensel, Kansas City, Kans.

[73] Assignee: Laser Cycle, Inc., Lenexa, Kans.

[21] Appl. No.: 08/955,252

[22] Filed: Oct. 21, 1997

[51] Int. Cl.[6] ..... G03G 15/02

[52] U.S. Cl. ..... 399/100; 399/115

[58] Field of Search ..... 399/100, 115; 250/324–326; 361/229, 230

[56] References Cited

U.S. PATENT DOCUMENTS 5,485,255 1/1996 Reuschle et al. ..... 399/100 X 5,594,532 1/1997 Tuvesson et al. ..... 399/100

5,697,019 12/1997 Kim ..... 399/100

*Primary Examiner*—William Royer

*Attorney, Agent, or Firm*—Lathrop & Gage, LC

[57] ABSTRACT

A cleaning assembly for polishing debris from a corona wire is disclosed. The cleaning assembly includes a seat movably mounted within a housing to slide along the length of the corona wire. The seat has a polishing element configured to deflect the corona wire from an operating position. The assembly further includes a handle protruding from the housing whereby as the handle is pulled away from the housing along a plane defined by the length of the corona wire, the polishing element deflects the corona wire and polishes the taut wire to clean the corona wire.

17 Claims, 6 Drawing Sheets

APPARATUS FOR CLEANING TONER SUPPLY CARTRIDGE CORONA WIRE

FIELD OF INVENTION

This invention relates to a cartridge cleaning apparatus and, more particularly, to an apparatus for cleaning a corona wire in a toner supply, such as a toner cartridge for a printer, facsimile, or copy machine.

BACKGROUND OF THE INVENTION

Stand-alone printers have become increasingly popular for document printing at the work place and home. These printers typically employ a toner supply device (such as a toner cartridge) provided with a corona wire for image formation processing.

A problem with these stand-alone printers is the accumulation of excess toner and other debris on the corona wire. These accumulations are burned onto the corona wire due to the high voltage placed on the corona wire during operation. These accumulations can deteriorate the printer quality and can interrupt the continuous use of these printers by causing print defects, such as smudging or dark streaks on the printed pages. For some cases, these defects could be cured by simply wiping the debris from the small thin corona wire in the printer toner cartridge. To address this simple problem and allow maximum working time, cleaning apparatus were developed that allow the user to clean the corona wire.

For example, in the IBM LaserPrinter Series toner cartridge, a long narrow plastic arm extends the width of the printer cartridge (i.e., the length of the corona wire) and includes a seat residing at one end of the arm. This seat houses a felt piece that wraps around the corona wire. The other end of this arm includes a handle that protrudes from the side of the printer cartridge, allowing the user to access and manipulate the plastic arm. When the corona wire needs to be cleaned, the user holds the handle and pulls the long plastic arm out from the side of the cartridge causing the felt piece to slide along the length of the corona wire. The toner and other debris accumulated on the corona wire adheres to the felt piece or is pushed off or along the wire.

Other types of cartridge cleaning apparatus include a member that is pressed upward against the wire for the purpose of cleaning the corona wire, as described in U.S. Pat. No. 4,788,573 to Nakaoka, et al. The teachings of this patent are incorporated herein by reference. The pressure force imparted by the upper pressing of these types of cleaning cartridge must be predetermined and controlled to ensure that the corona wire is not broken.

The problem with these cartridge cleaning apparatus is that only the loose toner and debris is cleaned from the corona wire. The toner that has burned onto the corona wire due to the high voltage placed on the corona wire during operation is not removed by felt type cleaners.

SUMMARY OF THE DISCLOSURE

An object of the preferred embodiment of the present invention is to provide a cartridge cleaning apparatus that allows a user to easily free the corona wire from toner or debris, including toner and debris that has burned onto the corona wire, by polishing the wire such that it is free from the burnt toner and debris.

The foregoing object of the invention is achieved by providing a cleaning assembly for polishing debris from a corona wire. The assembly comprises a seat movably mounted within a housing to slide along the length of the corona wire. The seat includes a polishing element configured to deflect the corona wire from an operating position. The assembly further comprises a handle protruding from the housing whereby as the handle is pulled away from the housing along a horizontal plane defined by the length of the corona wire, the polishing element deflects the corona wire and polishes the taut wire to clean the corona wire.

The foregoing features, objects and advantages of the invention will become apparent to those skilled in the art the following detailed description of a preferred embodiment.

DETAILED DESCRIPTION OF THE PREFERRED EMBODIMENT

Figure 1:
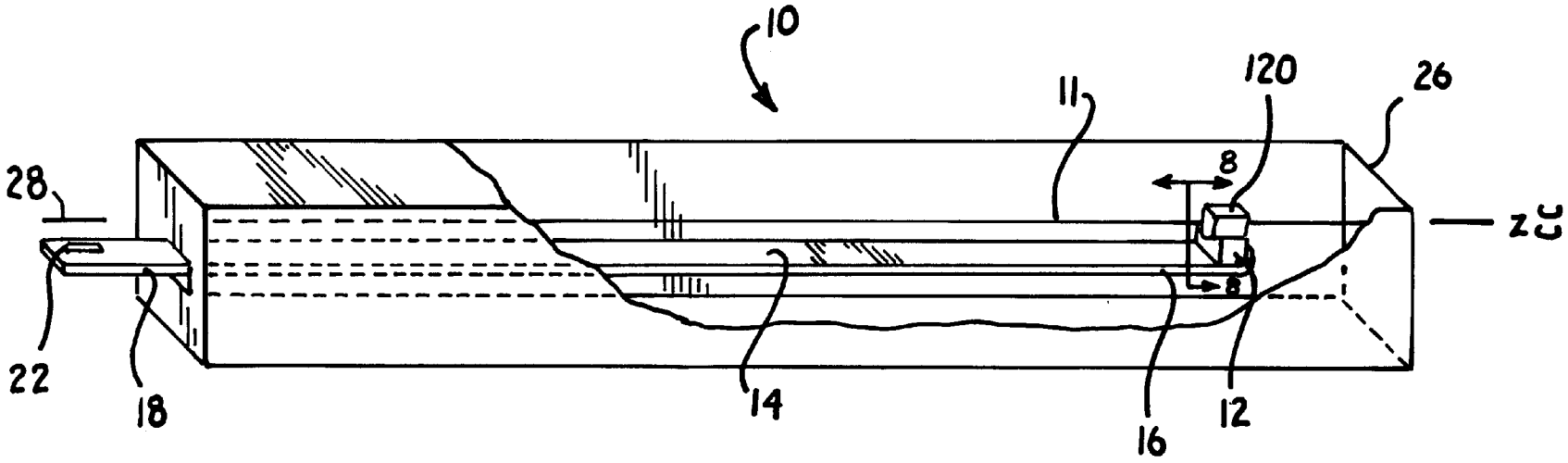
FIG. 1 is a perspective view of a cleaning assembly constructed in accordance with the present invention, with a portion of the toner supply cut-away to show the polishing element.

Referring to FIG. 1, a cleaning assembly for polishing debris from a corona wire is generally indicated at 10. For purposes of description of the preferred embodiment, the following description pertains to toner cartridges in printers. It is to be understood, however, that the present invention may be used to clean a corona wire on other systems such as facsimile machines and photocopy machines.

The cleaning assembly 10 of the present invention comprises a seat 12 movably mounted within a housing 26 to slide along the length of the corona wire 11, a polishing element 20 mounted to the seat 12, an elongate wand 14 having a distal end 16 and a proximal end 18, and a handle 22 mounted to the proximal end of the wand 14.

The seat 12 of the cleaning assembly 10 is mounted to the distal portion 16 of the wand 14 and extends upwardly away from the wand. In the preferred embodiment, the seat 12 is a unitary structure having a generally inverted "U" shape. The seat 12 is approximately ¼" in height and 1/16" in depth. The seat 12 includes a bore 21 formed therethrough for receiving the polishing element 20. The receiving bore 21 is approximately ⅛" in diameter. It is to be understood that other dimensions may be used and still be within the scope of the present invention.

Figure 9:
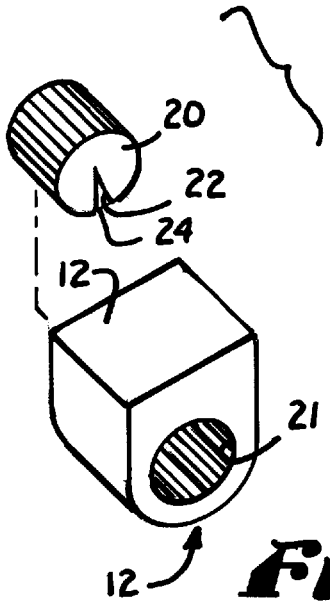
FIG. 9 is an exploded view of the polishing element and seat of the cleaning assembly.
Figure 10:
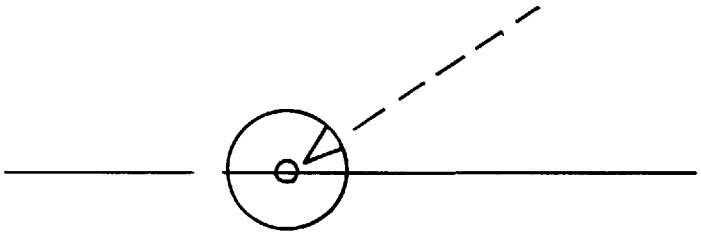
FIG. 10 is a schematic view of the degree of offset of the opening of the polishing assembly from the plane defined by the corona wire.

The polishing element 20 is preferably cylindrically configured to fit into the receiving portion of the cleaning assembly's seat 12. The polishing element 20 is made of an elastomeric compound, such as urethane rubber available from List Pencil Corp. The polishing element 20 includes an opening 22 for accepting the corona wire 11 therethrough. This opening 22 is preferably a wedge-shaped slit formed along the length of the cylindrical polishing element 20. This opening 22 has an interior surface 24 on which an abrasive material is embedded (FIG. 9). Preferably, this abrasive material is microscopic in size, such as Alumina Compound, available from Universal Photonics. It will be understood that other material may be used for the polishing element 20 and abrasive material without departing from the scope of the present invention.

The opening of the cleaning assembly's 10 polishing element 20 is offset from a horizontal plane 28 extending through the corona wire 11 to deflect the wire from its operating position as the polishing element 20 travels along the length of the wire. As such, the portion of the corona wire 11 resting against the interior surface 24 of the opening is tautly held against the interior surface. As the polishing element 20 slides along the wire 11, the abrasive material of the interior surface 24 forcibly scrapes burnt toner and debris from the corona wire. In the preferred embodiment, the offset of the polishing element 20 from the horizontal plane 28 of the corona wire 11 is approximately 5°. It will be understood that many other offsets may be used without departing from the scope of the invention.

The wand 14 of the cleaning assembly 10 is an elongate, thin plastic member that extends the length of the corona wire 11. The wand 14 includes a handle 22 on the proximal end 18 of the wand for manipulation by the user. The wand 14 is preferably approximately ¼" in width and 1/16" thick. It is to be understood that the wand can be made of may different dimensions without departing from the scope of the present invention. The handle 22 is made of a flexible plastic material, such as polyvinyl chloride, available from G.E. Plastics Division. As such, the handle 22 can fit within the printer housing 26 without requiring additional space.

Figure 2:
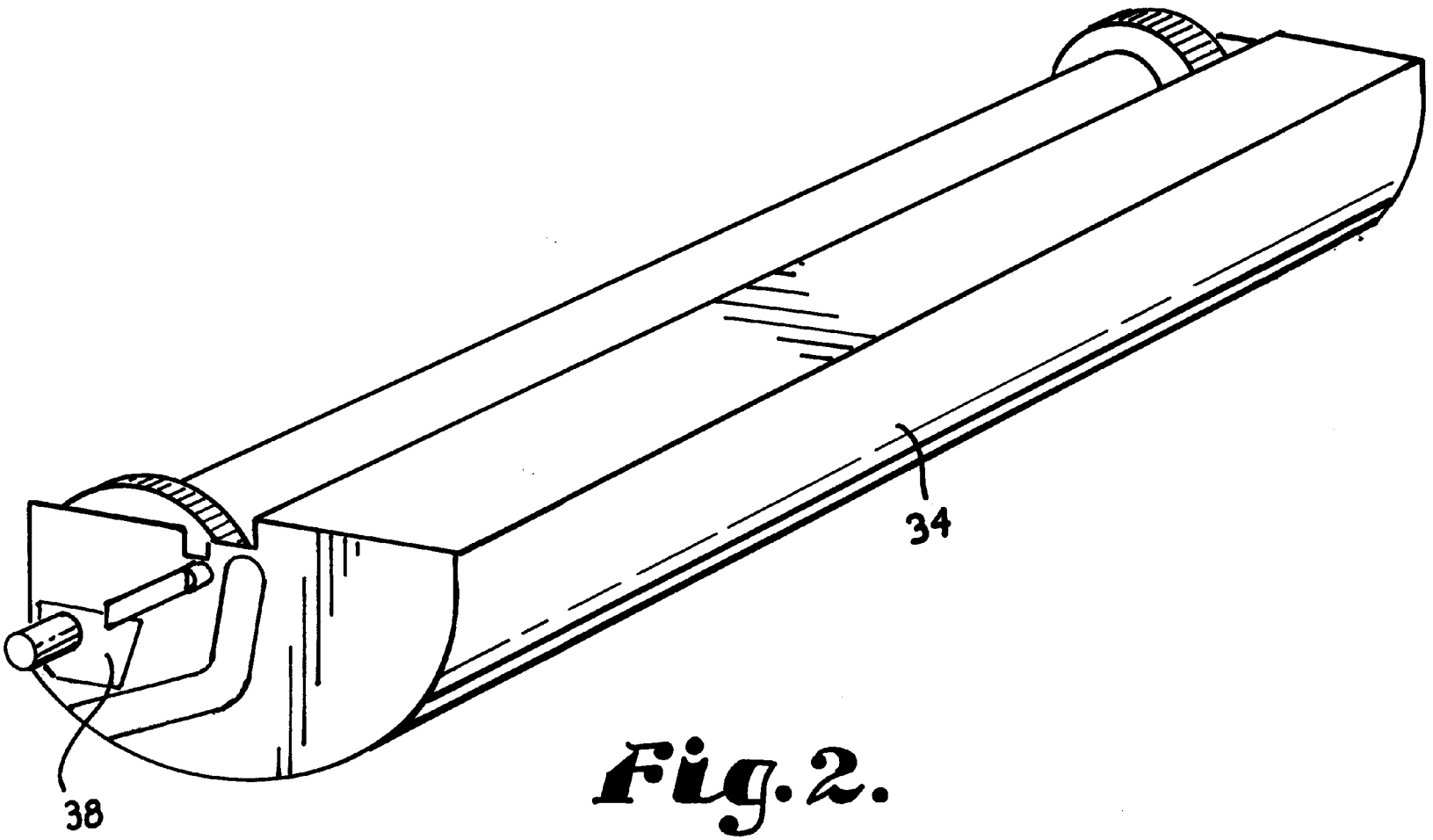
FIG. 2 is perspective view of a waste hopper showing the guide for the cleaning assembly wand.
Figure 3:
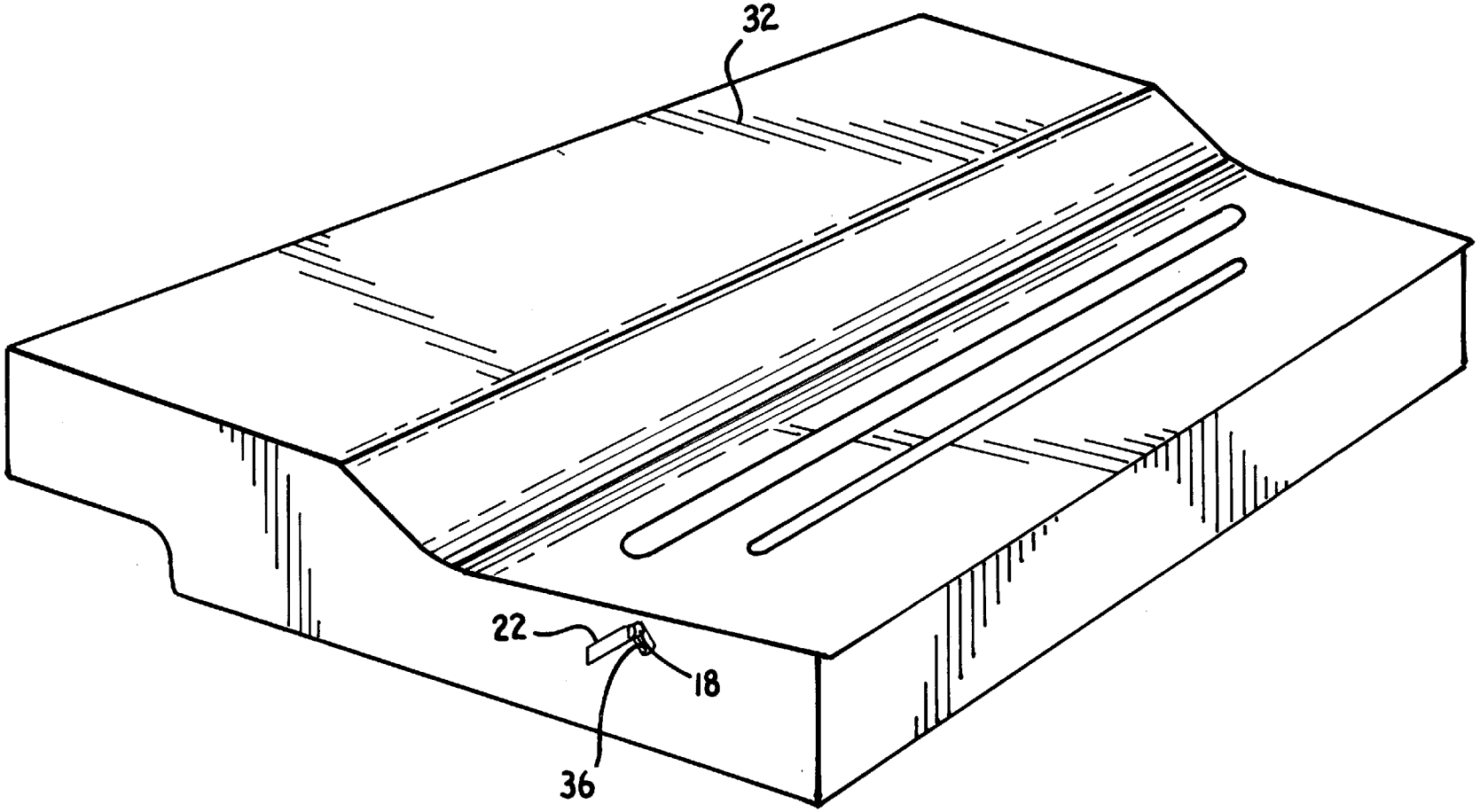
FIG. 3 is a perspective view of a cover of the toner cartridge showing the guide for the cleaning assembly wand.
Figure 4:
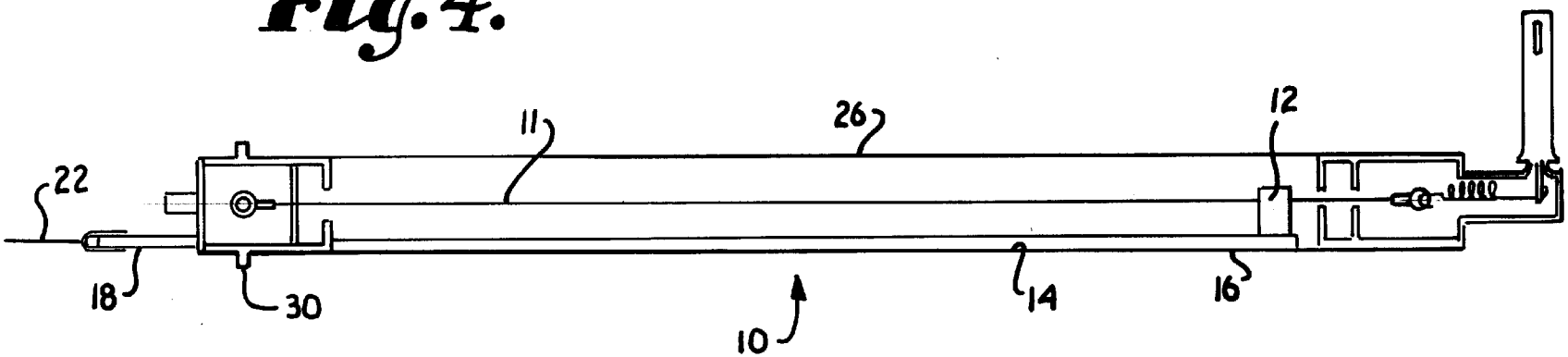
FIG. 4 is a side elevational view of the cleaning assembly of the instrument of the present invention.
Figure 6:
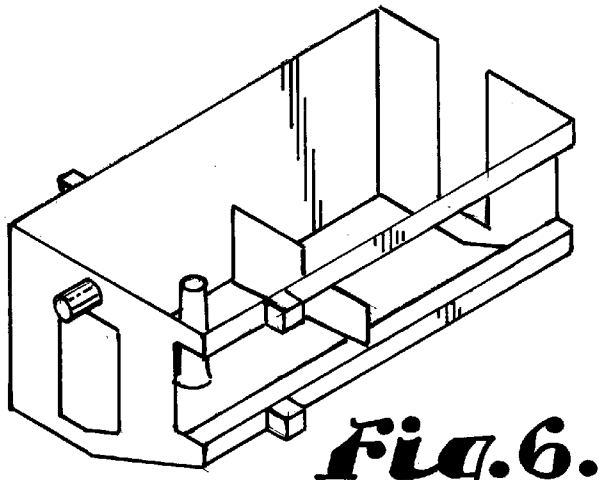
FIG. 6 is a perspective view of the end of the toner supply showing the guide for the wand of the cleaning assembly.
Figure 5:
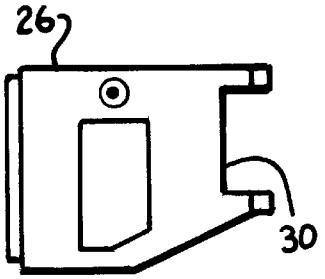
FIG. 5 is a side elevational view of the end of the toner supply showing the guide for the wand of the cleaning assembly.
Figure 7:
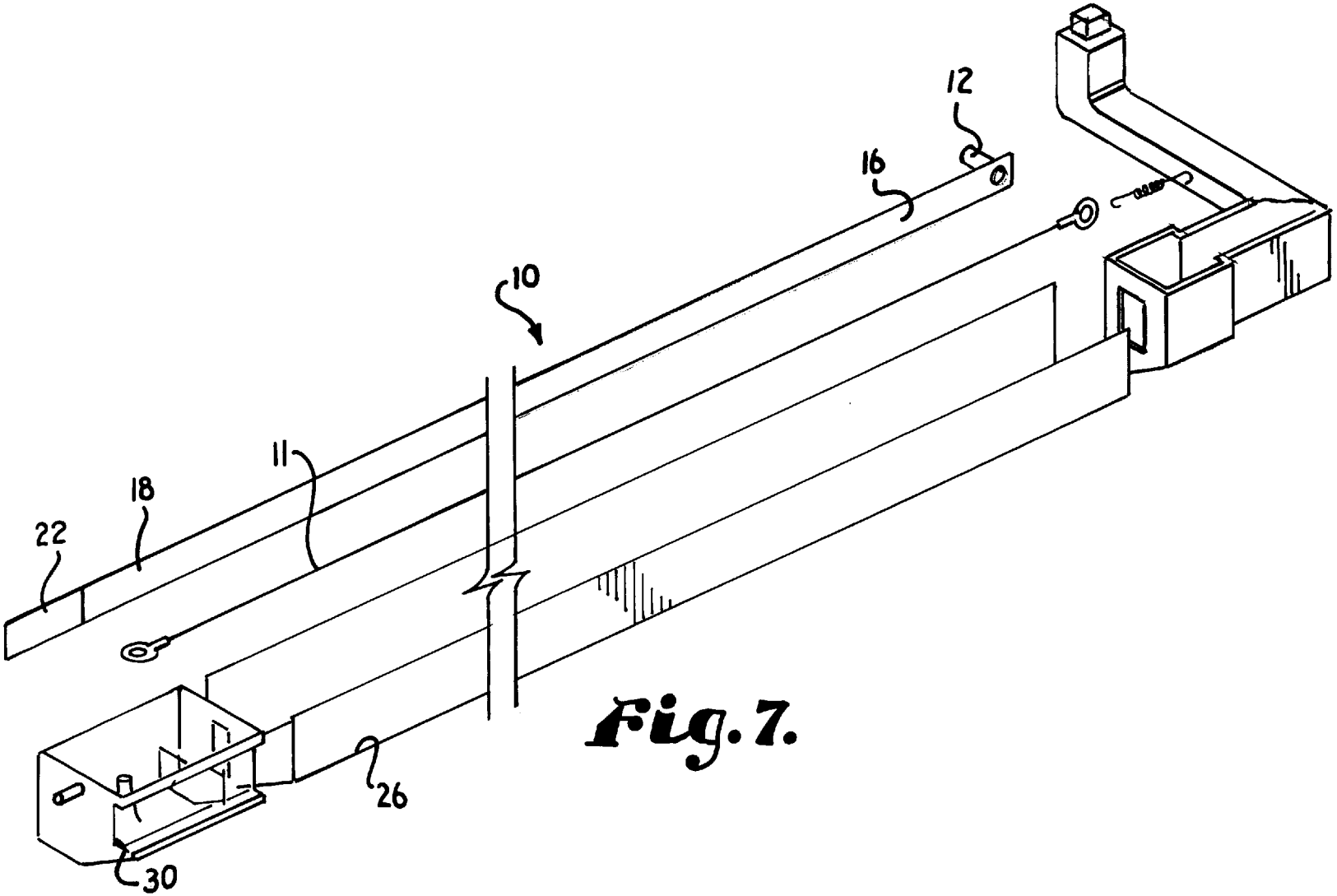
FIG. 7 is an exploded view of the toner supply and cleaning assembly of the present invention.
Figure 8:
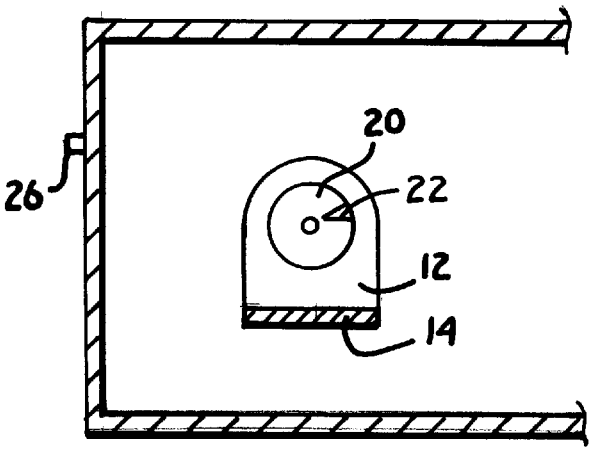
FIG. 8 is a view taken along line 8–8 of FIG. 1.

The cleaning assembly 10 mateably couples into the housing 26 of the toner cartridge to align the polishing element 20 with the corona wire 11. The wand 14 of the cleaning assembly 10 slidably mates with a guide 30 formed on a side of the housing 26. The guide 30 is configured to accept the wand 14 (FIGS. 4–6). As mated, the handle 22 of the cleaning assembly 10 is positioned on the outside of the toner cartridge, and the seat 12 and polishing element 20 extend into the interior chamber of the housing 26 such that the polishing element 20 engages the corona wire 11. The cover 32 and waste hopper 34 of the toner cartridge are likewise fabricated with guides 36, 38, respectively, to feed and guide the cleaning wand 14 as it is pulled from one end of the corona wire 11 to the other end (FIGS. 2 and 3).

In operation, the cleaning assembly 10 resides in a toner cartridge. The cartridge comprises a housing 26 having a slot 30 configured to accept the wand 14 of the cleaning assembly. The cleaning assembly 10 is contained within this housing 26 such that the handle 22 mates with the slot 36 in the cartridge cover 32. The cleaning assembly 10 as assembled within the housing 26 has the opening of the polishing element 20 in line with a portion of the corona wire 11.

If streaks or other printing defects appear on the documents, the cartridge can be removed from the printer (or the printer housing 26 opened) such that the handle 22 is exposed. The user can grab the handle 22 and pull the handle outwardly away from the toner cartridge the length of the corona wire 11. As the wand 14 is pulled along the length of the wire 11, the polishing element 20 deflects the wire from its normal operating position (along the horizontal plane 28) against the abrasive interior surface 24 of the polishing element 20. The abrasive material polishes the burnt toner and debris from the corona wire 11 to clean the wire.

The preferred embodiment of the cartridge cleaning assembly 10 has been described herein. While this particular embodiment has been described in detail, it is not intended that the invention be limited thereto, as it is intended that the invention be afforded as broad a scope as the art will allow and the specification be read likewise. It will therefore be appreciated by those skilled in the art that yet other modifications could be made to the provided invention without departing from the scope as so claimed by the present invention.

That which is claimed:

1. A cleaning assembly for polishing debris from a corona wire in a toner cartridge, the corona wire having a length extending in a housing of the toner cartridge and defining a horizontal plane extending through the corona wire, the cleaning assembly comprising, a seat movably mounted within the housing to slide along the length of the corona wire, the seat having a polishing element configured to receive a portion of the corona wire and deflect the portion of the corona wire from an operating position such that the portion of the corona wire received in the polishing element is tautly held against the polishing element, and a handle associated with the seat and protruding from the housing, the handle being operable to be pulled away from the housing parallel to the horizontal plane extending through the corona wire to move the polishing element along the length of the corona wire to polish the corona wire.

2. The cleaning assembly of claim 1 wherein the polishing element is offset from the horizontal plane extending through the corona wire to deflect the portion of the corona wire received in the polishing element from the operating position as the seat travels along the length of the corona wire whereby the portion of the corona wire received in the polishing element is tautly held against the polishing element and scraped clean as the polishing element travels the length of the corona wire.

3. The cleaning assembly of claim 2 wherein the offset of the polishing element from the horizontal plane extending through the corona wire is 5°.

4. The cleaning assembly of claim 1, wherein the polishing element comprises an opening to accept the corona wire therethrough, the opening being offset from the horizontal plane extending through the corona wire to deflect the corona wire from the operating position.

5. The cleaning assembly of claim 4 wherein the polishing element further comprises an abrasive material fabricated on an interior surface of the opening whereby as the seat is moved along the length of the corona wire the portion of the corona wire received in the polishing element is deflected from the operating position and is scraped by the abrasive material of the polishing element to remove debris from the corona wire.

6. The cleaning assembly of claim 1 wherein the polishing element is substantially cylindrical, the polishing element further comprising a slit configured to accept the corona wire therethrough.

7. The cleaning assembly of claim 6 wherein the slit is configured to be offset from the horizontal plane extending through the corona wire such that the corona wire is deflected from the operating position as the polishing element is moved along the length of the corona wire.

8. The cleaning assembly of claim 7 wherein the slit has an interior surface for contacting the corona wire, the interior surface comprising an abrasive material to forcibly scrape debris from the corona wire as the polishing element moves along the length of the corona wire and deflects the corona wire from the operating position.

9. The cleaning assembly of claim 8 wherein the slit of the polishing element is offset 5° from the horizontal plane extending lengthwise through the corona wire.

10. The cleaning assembly of claim 9 wherein the handle of the cleaning assembly comprises a flexible elastomeric material.

11. A cleaning assembly for polishing debris from a corona wire in a toner cartridge, the corona wire having a length extending in a housing of the toner cartridge and defining a horizontal plane extending through the corona wire, the cleaning assembly comprising, a seat movably mounted within the housing to slide along the length of the corona wire, the seat having a polishing element comprising an opening for accepting and deflecting the corona wire from an operating position and an abrasive material for polishing the corona wire as it slides through the opening, and a handle associated with the seat and protruding from the housing, the handle being movable along the horizontal plane defined by the length of the corona wire to move the seat along the corona wire and polish the corona wire.

12. The cleaning assembly of claim 11 wherein the polishing element is offset from the horizontal plane extending through the corona wire to deflect the corona wire as it travels along the length of the corona wire.

13. The cleaning assembly of claim 12 wherein the offset of the polishing element from the horizontal plane extending through the corona wire is 5°.

14. The cleaning assembly of claim 12 wherein the abrasive material is fabricated on an interior surface of the opening whereby as the seat is moved along the length of the corona wire the corona wire is scraped by the abrasive material of the polishing element to remove debris from the corona wire.

15. The cleaning assembly of claim 14 wherein the opening is a slit configured to be offset from the horizontal plane extending through the corona wire such that the portion of the corona wire received in the polishing element is deflected from the operating position as the polishing element is moved along the length of the corona wire.

16. The cleaning assembly of claim 15 wherein the slit of the polishing element is offset 5° from the horizonal plane extending through the corona wire.

17. The cleaning assembly of claim 16 wherein the handle of the cleaning assembly comprises a flexible elastomeric material.

* * * * *